US007429100B2

(12) United States Patent
Pechtl

(10) Patent No.: US 7,429,100 B2
(45) Date of Patent: Sep. 30, 2008

(54) METHOD AND DEVICE FOR INCREASING NUMBER OF INK DROPS IN AN INK DROP JET OF A CONTINUOUSLY OPERATING INKJET PRINTER

(76) Inventor: Klaus Pechtl, Weinbergstrasse 15, Stadtschwarzach (DE) 97359

( * ) Notice: Subject to any disclaimer, the term of this patent is extended or adjusted under 35 U.S.C. 154(b) by 0 days.

(21) Appl. No.: 11/683,646

(22) Filed: Mar. 8, 2007

(65) Prior Publication Data

US 2007/0211098 A1 Sep. 13, 2007

(30) Foreign Application Priority Data

Mar. 8, 2006 (DE) ..... 10 2006 011 072

(51) Int. Cl.
*B41J 2/085* (2006.01)

(52) U.S. Cl. ..... 347/76

(58) Field of Classification Search ..... 347/76, 347/77, 82, 74, 75

See application file for complete search history.

(56) References Cited

U.S. PATENT DOCUMENTS 3,298,030 A 1/1967 Lewis et al.
6,478,414 B2 * 11/2002 Jeanmaire ..... 347/77
7,004,555 B2 * 2/2006 Sugahara ..... 347/9
2005/0122381 A1 * 6/2005 Golombat et al. ..... 347/77

FOREIGN PATENT DOCUMENTS

DE 221691 A1 5/1985
JP 2004122775 A 4/2004

OTHER PUBLICATIONS

German Search Report, Sep. 19, 2006.

* cited by examiner

*Primary Examiner*—K. Feggins
(74) *Attorney, Agent, or Firm*—Walter G. Hanchuk; Chadbourne & Parke LLP

(57) ABSTRACT

The invention concerns a method for increasing the number of ink drops in an ink drop jet of a continuously operating inkjet printer, in which the ink drops of at least two separately produced ink drop jets are combined into an ink drop jet. In one example embodiment this is done so that the combined ink drop jet includes the ink drops of the respective separate ink drop jets. The invention also concerns a device for production of an ink drop jet of a continuously operating inkjet printer, which includes at least two pressure chambers for generation of a separate ink drop jet with electrically charged ink drops and an electrode arrangement wherein the separate ink drop jets can be combined into a singe ink drop jet.

35 Claims, 3 Drawing Sheets

METHOD AND DEVICE FOR INCREASING NUMBER OF INK DROPS IN AN INK DROP JET OF A CONTINUOUSLY OPERATING INKJET PRINTER

RELATED APPLICATION(S)

Applicants hereby claim priority under 35 USC § 119 for German Patent Application No. 10 2006 011 072.2 filed Mar. 8, 2006, entitled "VERFAHREN UND VORRICHTUNG ZUR ERHOHUNG DER TINTENTROPFENANZAHL IN EINEM TINTENTROPFENSTRAHL EINS KONTINUIERLICH ARBEITENDEN TINTENSTRAHL-DRUCKERS" incorporated herein by reference.

FIELD OF THE INVENTION

The invention concerns the field of continuously operating inkjet printers which have been used industrially for many years to mark a wide variety of products.

BACKGROUND

In general, the single jet continuously operating inkjet printer and the multi-jet continuously operating inkjet printer are two variants of printers previously developed that can be distinguished technically, but are based on the same principle.

SUMMARY

According to one aspect of the current invention, the number of ink drops available for the printing process is increased, or multiplied several-fold to increase the printing speed of a continuously operating inkjet printer.

In accordance with another aspect of the invention, the ink drops are combined from at least two separately produced ink drop jets to one ink drop jet, so that in one example embodiment, the combined ink drop jet fully encloses the ink drops of the corresponding separate ink drop jets. Deflection of the ink drops combined to an ink drop jet to produce a text pattern can occur by means of appropriate deflection measures.

In one example embodiment, this can be achieved in that the ink drops of the separately produced ink drop jets are each charged with an electric charge and combined to a single ink drop jet by deflection in at least one electric, or electrostatic field. In one example embodiment, a device, such as, but not limited to a print head of a continuously operating inkjet printer can include at least two pressure chambers. Each of these is capable of producing a separate ink drop jet with electrically charged ink drops and an electrode arrangement, so the separate ink drop jets can be combined to one ink drop jet. A charging electrode arrangement can be arranged after such a printing chamber in the drop flight direction in order to charge the ink drops with an electric charge where, for example, each ink drop can be charged with the same charge. The ink drops in a separate ink drop jet can therefore acquire a charge, which can be the same or different in drops of different jets.

In accordance with another aspect of the invention, combining of the ink drops to a single drop jet can occur so that the separate ink drop jets are each arranged at an angle relative to each other before deflection. For example, by aligning the pressure chambers at an angle relative to each other so that the undeflected separate drop jets intersect each other, all intersect at a common intersection point. Because of this, it is particularly simple to deflect the individual ink drops of each separate ink drop jet and approach a common flight path, asymptotically, for example, so that a combined ink drop jet is formed. In one example embodiment, it can be prescribed that at least one ink drop jet already have the same flight path as the combined ink drop jet when produced, i.e., be coaxial to it.

In one example embodiment, in order to provide for uniform combining of the ink drops from the individual jets within a combined ink drop jet, i.e., an equidistant spacing relative to each other, it can be prescribed that the ink drops of the separate ink drop jets be combined to a common ink drop jet in phase-shifted fashion, with the same sequence frequency. The phase shift here can be produced by the phase-shifted electronic driving of pressure chambers that produce separate ink drops in terms of time and/or by spatial displacement of a pressure chamber along the direction of a separate ink drop jet.

In order to provide for this, in one example embodiment, the modulation elements of the at least two pressure chambers can be driven with the same frequency so that the ink drops emerging from the at least two pressure chambers can be generated directly with the pressure chambers phase-shifted in time and space, for example, by adjustability and/or phase shiftability of the excitation frequency of the modulation elements of the at least two pressure chambers.

In order to achieve equidistant spacing, the phase shift of the ink drop between two separate ink drop jets may be chosen at 360°/n, where n is the number of separate ink drop jets.

In another example embodiment, deflection of the separate ink drop jets to a combined ink drop jet can be accomplished with an electrode arrangement, which acts through at least one electric field, for example, an electrostatic field, on at least two separate ink drop jets and is field-free in the area of the combined ink drop jets. An influence on the combined ink drop jet is thus avoided.

For example, an electrode arrangement to combine two separate ink drop jets can be formed by a first electrode and a second electrode, between which a third electrode is arranged, in which a first separate ink drop jet runs between the first and third electrodes and a second ink drop jet between the second and third electrodes. In this example embodiment, the first and second electrodes can have the same electric potential, which is different from that of the third electrode, which, for example, can be grounded.

Since the ink drops may be combined in the electrode arrangement to a jet, another example embodiment can be arranged so that the third electrode is arranged in the drop flight direction between the first and second electrodes so that it ends in the flight direction. With this arrangement the field-free space is produced behind the third electrode, because the first and second electrodes lie at the same potential.

In still another embodiment of the method and device it can also be prescribed that at least one of the separate ink drop jets be guided field-free through an electrode arrangement for deflection of at least one other separate ink drop jet, for example, where the ink drop jet guided field-free is produced collinear or coaxial to the combined ink drop jet. Thus, when there are two ink drop jets to be combined, one of the separate ink drop jets can be brought close to the other one, for example, this can be done asymptotically, or two separate ink drop jets can be brought close to a third separate ink drop jet, for example, asymptotically, from both sides.

For example, in the aforementioned embodiment of the electrode arrangement it can be prescribed that the third separate ink drop jet runs through the third electrode, which runs through the electrode field-free and is arranged collinear or coaxial to the combined ink drop jet.

In this example embodiment, the shaping of the individual electrodes is such that the electrode surfaces facing the drops are adapted with respect to the surface to the changing flight path of the drops. In this case, the third electrode arranged between the two outer electrodes is designed to taper in the flight direction of the drops, the tapering can be nonlinear tapering.

For further stabilization it can be prescribed in any embodiment that an additional electrode arrangement for stabilization of the flight paths of the individual ink drops of the combined ink drop jet be connected after the electrode arrangement for combining of the separate ink drop jets.

The combining of several separate ink drop jets need not necessarily occur in a single step. It can also happen, for example that groups of separate ink drop jets can be combined to one ink drop jet, which in turn can be combined with other ink drop jets.

This can be performed through different electrode arrangements in which between electrode arrangements for combining there are electrode arrangements for additional deflection of the drops.

DETAILED DESCRIPTION

Figure 1:
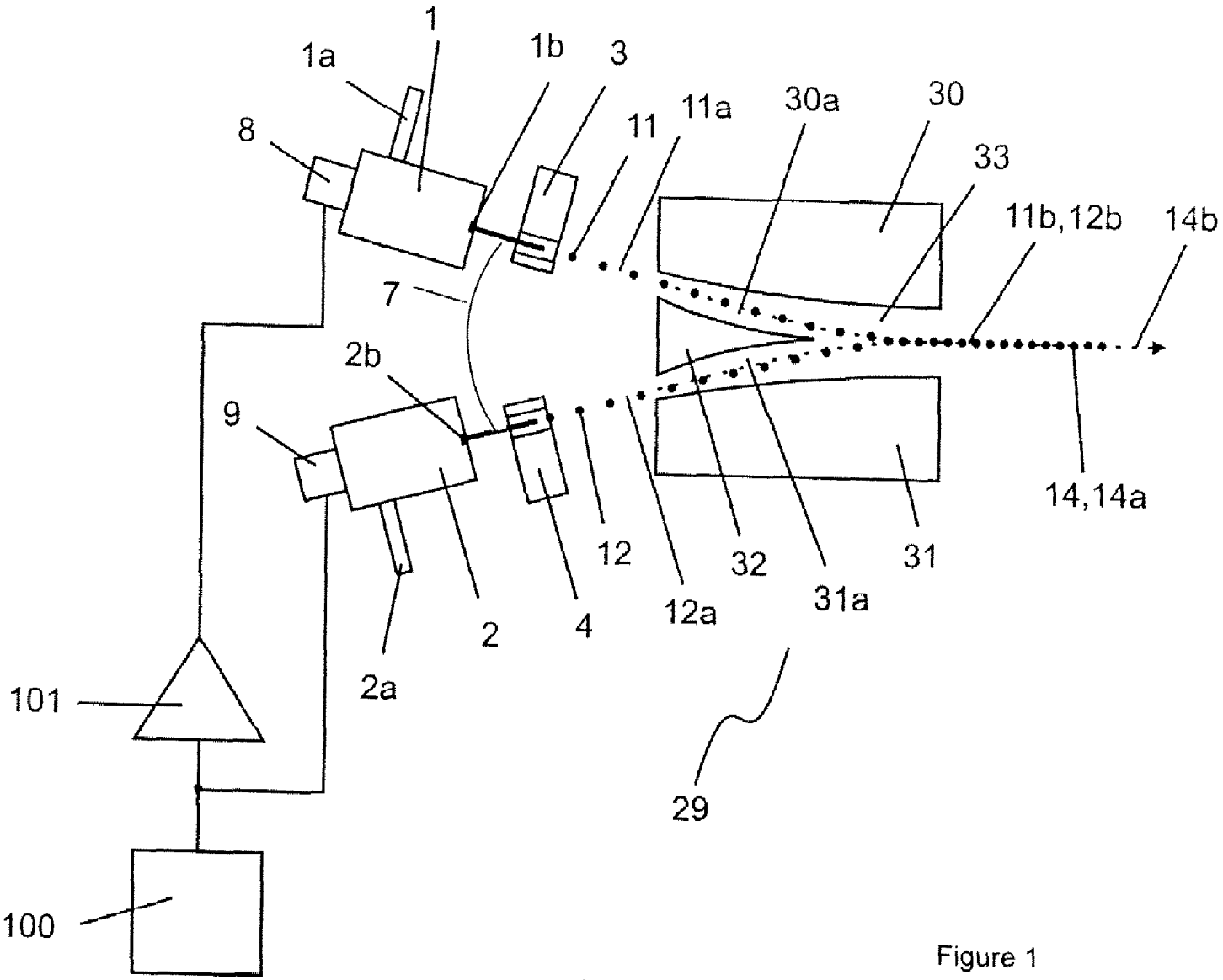
FIG. 1: shows a print head according to the invention for combining two separate ink drop jets in an electrode arrangement.

FIG. 1 shows that, according to one aspect of the invention, in addition to the pressure chamber 1 in the print head of a continuously operating inkjet printer, at least one additional essentially identical pressure chamber 2 is provided with the task of introducing additional ink drops 12 into the gaps between the ejected ink drops 11 that are ejected from pressure chamber 1, in order to double the number of available ink drops 14 or multiply them according to the number of employed pressure chambers.

Ink is supplied into the pressure chambers 1 and 2 via pumps (not shown) through ink feed lines 1*a* and 2*a* from an ink vessel (not shown). A nozzle opening 1*b* and 2*b* from which the ink emerges from the pressure chamber is situated on the end of each pressure chamber 1 and 2.

The ink pressure in the interior of pressure chambers 1 and 2 is modulated by the modulation devices 8 and 9 so that the initially continuous inkjet is broken up right after emerging from the nozzle opening into individual ink drops 11 and 12. Right before breaking up the inkjets 11*a* and 12*a*, into individual ink drops 11 and 12 the inkjets 11 *a* and 12*a* are each provided with an electric charge via the charge electrodes 3 and 4.

The modulation devices 8 and 9 used to produce the individual ink drops 11 and 12 of the corresponding pressure chambers 1 and 2 are excited by a common oscillator 100 and operate in this variant phase-shifted relative to each other via a phase shifter 101, for example, by 360°/n, where n denotes the number of employed pressure chambers.

For example, if a total of two pressure chambers are used, as shown in FIG. 1, the pressure chambers operate phase-shifted by 180° so that the ejected drops 111 of pressure chamber 1 are shifted in time and space relative to the ejected drops 12 of pressure chamber 2 by a half-wavelength of the excitation frequency and ejected from the corresponding nozzles 1*b* and 2*b*.

The drops 11 and 12 ejected from each pressure chamber 1 and 2 are provided in the manner already described with an electric charge by means of a charge device 3 and 4 situated in front of each of the pressure chambers 1 and 2, in which according to this aspect of the invention each ejected drop from a pressure chamber 1 and 2 acquires the same electric charge. The charges of the different pressure chambers 1 and 2 can be different or the same, depending on the requirements.

In order to combine the ink drops 11 and 12 of the corresponding ink drop jets 11*a* and 12*a* into a common ink drop jet 14*a*, the pressure chambers 1 and 2 are configured such that their respective ink drop flight paths 11*b* and 12*b* may have a geometric slope relative to each other at an angle 7, for example, so that the flight paths 11*b* and 12*b* of the ejected ink drops 11 and 12 would initially meet a geometric intersection point.

On their flight the ink drops 11 and 12 go in succession into an electrode arrangement 29, in which the drops 11 and 12 each pass through an electric field 30*a* or 31*a*, which is built up by means of the electrodes 30, 31 and 32 lying at different electric potentials.

According to the height of the potential and the polarity of the corresponding electrodes 30, 31 and 32 an electric field is produced between electrode pairs 30 and 32 and/or 31 and 32 so that the electrically charged ink drops 11 and/or 12 deflect from their original flight paths into new flight paths 11 *b* and 12*b*.

With an appropriate geometric design of electrodes 30, 31 and 32 and the appropriate height of the electrical potentials of the corresponding electrodes it is possible to combine the new deflected flight paths 11 *b* and 12*b* to a common flight path 14*b* so that a combined ink drop jet is formed.

In one example embodiment, the electrodes 30 and 31 lie at the same potential so that the drops 14 deflected into the new flight path 14*b* experience no deflection forces because of potential differences between the electrodes 30 and 31 in the space 33 between electrodes 30 and 31, since in this case the electric field becomes zero. In order to guarantee a uniform spacing of the individual ink drops 14 of the new ink drop jet so formed along flight path 14*b*, the phase shifter 101 can be made adjustable.

Figure 2:
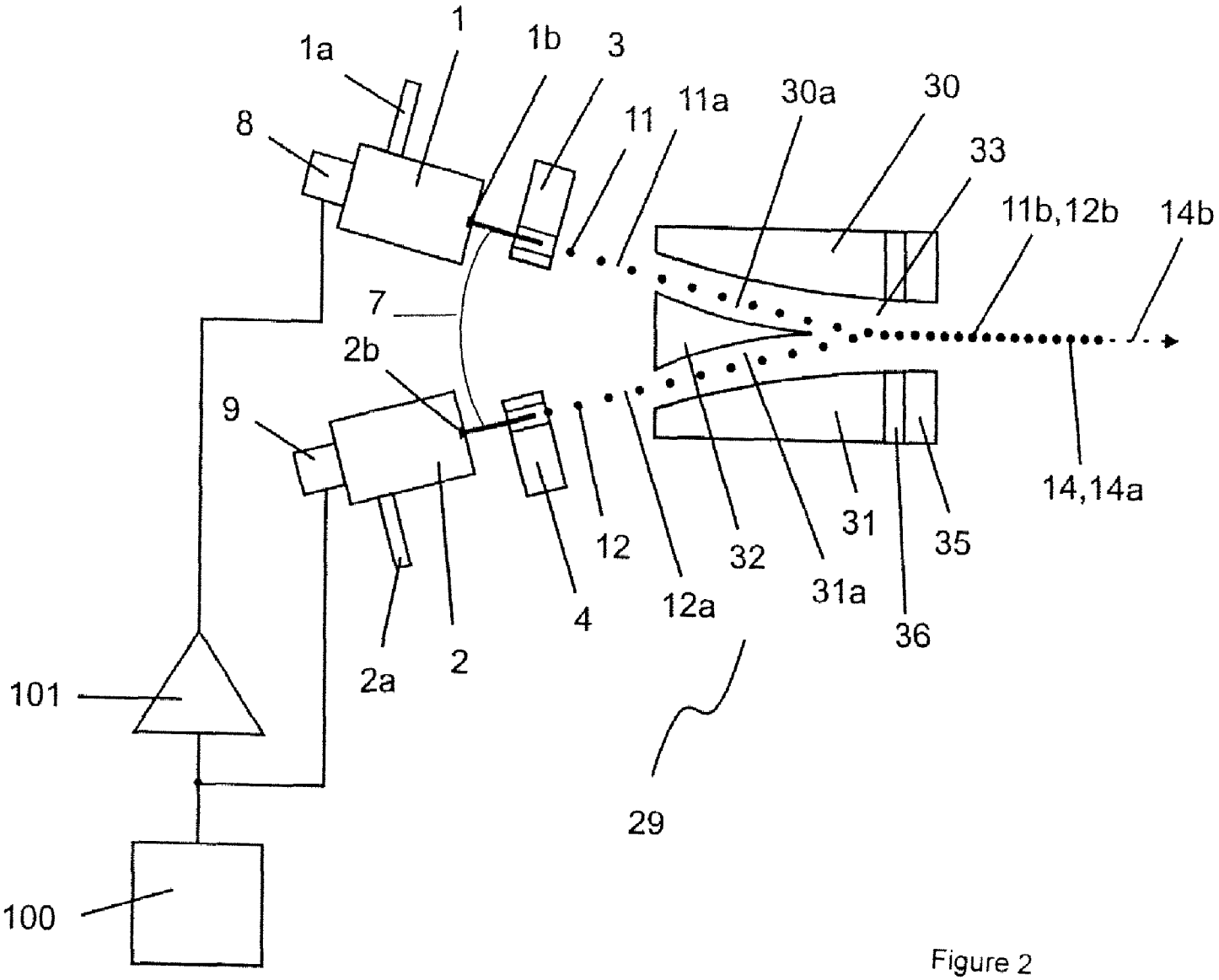
FIG. 2: shows an example arrangement according to FIG. 1 with an electrode arrangement for stabilization connected afterwards.

In another example embodiment, as schematically depicted in FIG. 2, it can be expedient to connect another electrode 35 after electrode arrangement 29, which is separated, for example, by an insulation layer 36 or by a distance from the electrode arrangement 29 and lies at a potential different from that of electrodes 30 and 31 and also has the same polarity as the charges of the ink drops 14 in order to correct any deviations in flight paths of the individual ink drops 14 from the desired flight path 14*b*.

Figure 3:
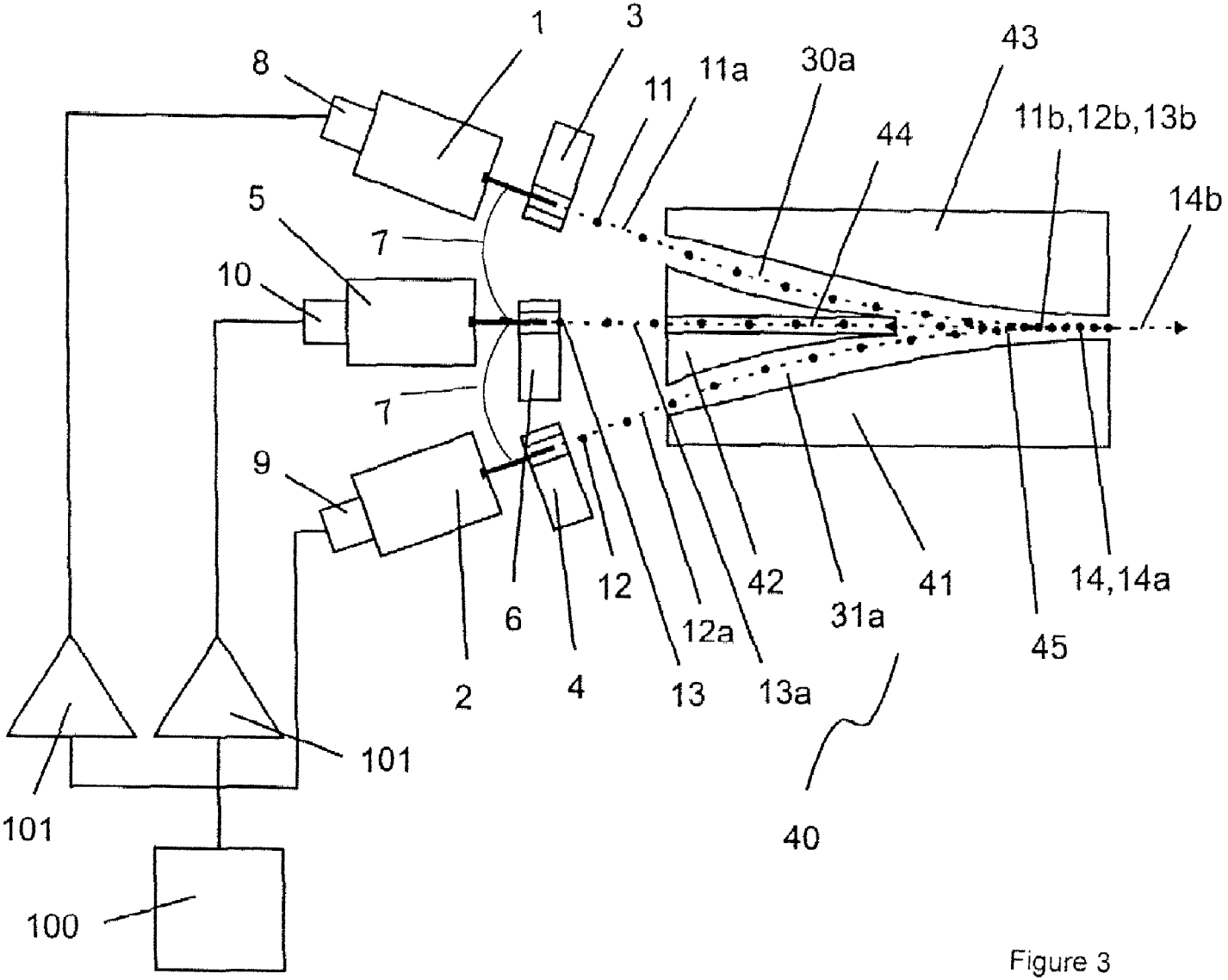
FIG. 3: shows a print head according to one aspect of the invention for combining three separate ink drop jets in an electrode arrangement.

In still another embodiment, as shown in FIG. 3, three pressure chambers 1, 2 and 5 are used, the corresponding ink drop jets 11*a*, 12*a* and 13*a* of which are combined by an electrode arrangement 40 to a common ink drop jet 14*a*.

For this purpose the modulation elements 8, 9 and 10 are excited by a common oscillator 100 and operate phase-shifted relative to each other via phase shifter 101 and 102 so that the ink drops 11, 12 and 13 are ejected from the pressure chambers 1, 2 and 5 in time and space relative to each other.

The example arrangement shown in FIG. 3 operates so that the electrode 42 has a central hole 44, through which the inkjet 13*a* enters the electrode arrangement 40 and is combined within the electrode arrangement 40 with the two other inkjets 11*a* and 12*a* to an emerging inkjet 14*a*.

Owing to the fact that the ink jet drops 13 in hole 44 runs within electrode 42, no electrostatic forces act on the charged ink drops 13 and the ink drops are not deflected from their original flight path. After the ink drops emerge from hole 44 of electrode 42 the ink drops 13 enter the area between the electrodes 41 and 43 whose electric potential is expediently the same. Because of this, no force acts on the ink drops 13 across their flight direction so that these retain their flight path 13*b*.

Deflection of the adjacent ink drop jet 11*a* and 12*a* flight paths occurs as already outlined above so that in area 45 all ink jets are combined to a common ink drop jet 14*a* and all ink drops have the same flight path 14*b*. In order to guarantee uniform spacing of the individual ink drops 14 of the new ink drop jet 14*a* so formed the phase shifters 101 and 102 can be made adjustable.

The entirety of this disclosure shows by way of illustration various embodiments in which the claimed inventions may be practiced. The advantages and features of the disclosure are of a representative sample of embodiments only, and are not exhaustive and/or exclusive. They are presented only to assist in understanding and teach the claimed principles. As such, it should be understood that advantages, embodiments, examples, functions, features, structures, and/or other aspects of the disclosure are not to be considered limitations on the disclosure as defined by the claims or limitations on equivalents to the claims.

The invention claimed is:

1. A method for increasing the number of ink drops in an ink drop jet of a continuously operating inkjet printer, comprising:

electrically charging ink drops of at least two separately produced ink drop jets; and combining the ink drops from the at least two separately produced ink drop jets to an ink drop jet by deflection in at least one electric field so that the combined ink drop jet includes the ink drops of the respective separate ink drop jets, and wherein the ink drops of the separate ink drop jets are combined phase-shifted relative to each other into an ink drop jet.

2. The method according to claim 1, wherein the at least one electric field is an electrostatic field.

3. The method according to claim 1, wherein the ink drops acquire the same charge in a separate ink drop jet.

4. The method according to claim 1, wherein the separate ink drop jets are arranged in an angle relative to each other before deflection.

5. The method according to claim 1, wherein the ink drops of the separate ink drop jets are combined phase-shifted relative to each other into an ink drop jet at the same frequency.

6. The method according to claim 1, wherein the phase shift is produced by phase-shifted electronic control of separate ink drop generating pressure chambers in terms of time shifting of a pressure chamber along the direction of at least one separate ink drop jet.

7. The method according to claim 1, wherein the phase shift is produced by phase-shifted electronic control of separate ink drop generating pressure chambers in terms of spatial shifting of a pressure chamber along the direction of at least one separate ink drop jet.

8. The method according to claim 1, wherein the phase shift is produced by phase-shifted electronic control of separate ink drop generating pressure chambers in terms of time and spatial shifting of a pressure chamber along the direction of at least one separate ink drop jet.

9. The method according to claim 1, wherein the phase shift of the ink drops between two separate ink drop jets is chosen at 360°/n, where n is the number of separate ink drop jets.

10. The method according to claim 1, wherein the deflection of separate ink drop jets to a combined ink drop jet is carried out by means of an electrode arrangement, which acts by at least one electric field, on at least two separate ink drop jets and is field-free in the area of the combined ink drop jet.

11. The method according to claim 1, wherein the at least one electric field is an electrostatic field.

12. The method according to claim 1, wherein at least one of the separate ink drop jets is guided field-free through an electrode arrangement for deflection of at least one other separate ink drop jet.

13. The method according to claim 12, wherein the at least one ink drop jet guided field-free is produced coaxial to the combined ink drop jet.

14. The method according to claim 1, wherein at least one of the separate ink drop jets is guided field-free through an electrode arrangement for deflection of at least one other separate ink drop jet, wherein the at least one ink drop jet guided field-free is produced coaxial to the combined ink drop jet.

15. The method according to claim 1, wherein groups of separate ink drop jets are combined to an ink drop jet, which in turn are combined again.

16. A device for generating an ink drop jet of a continuously operating inkjet printer, comprising:

at least two pressure chambers for generating a separate ink drop jet with electrically charged ink drops and an electrode arrangement structured to combine the separate ink drop jets into an ink drop jet, wherein the ink drops emerging from the at least two pressure chambers can be produced phase-shifted relative to each other in time and space.

17. The device according to claim 16, wherein the pressure chambers are aligned at an angle relative to each other so that the undeflected separate ink drop jets intersect each other at a common intersection point.

18. The device according to claim 16, wherein modulation elements of at least two pressure chambers are driven with the same frequency.

19. The device according to claim 16, wherein the ink drops emerging from the at least two pressure chambers can be produced phase-shifted relative to each other in time and space by adjustability of the excitation frequency of the modulation elements of the at least two pressure chambers.

20. The device according to claim 16, wherein the ink drops emerging from the at least two pressure chambers can be produced phase-shifted relative to each other in time and space by phase-shiftability of the excitation frequency of the modulation elements of the at least two pressure chambers.

21. The device according to claim 16, wherein the ink drops emerging from the at least two pressure chambers can be produced phase-shifted relative to each other in time and space by adjustability and phase-shiftability of the excitation frequency of the modulation elements of the at least two pressure chambers.

22. The device according to claim 16, wherein, in the drop flight direction after a pressure chamber a charging electrode arrangement is arranged in order to charge the ink drops with an electric charge.

23. The device according to claim 16, wherein, in the drop flight direction after a pressure chamber a charging electrode arrangement is arranged in order to charge the ink drops with an electric charge, wherein each ink drop is charged with the same charge.

24. The device according to claim 16, further comprising:

at least one electrode arrangement wherein at least one separate ink drop jet can be deflected so that it is combined with at least one other separate ink drop jet into an ink drop jet.

25. The device according to claim 24, further comprising:

an electrode arrangement for combining two separate ink drop jets formed by a first electrode and a second electrode between which a third electrode is arranged, in which a first separate ink drop jet runs between the first and third electrodes and a second ink drop jet runs between the second and third electrodes.

26. The device according to claim 25, wherein the first and second electrodes have the same electric potential.

27. The device according to claim 25, wherein the third electrode is arranged in the drop flight direction between the first and second electrode so that it is positioned in the flight direction.

28. The device according to claim 25, wherein a third separate ink drop jet runs through the third electrode, which runs field-free through the electrode and is arranged coaxial to the combined ink drop jet.

29. The device according to claim 24, wherein the electrode arrangement for combining the separate ink drop jets has an additional electrode arrangement positioned behind it to stabilize the flight paths of the individual ink drops of the combined ink drop jet.

30. The device according to claim 16 wherein the at least one electrode arrangement is a plate capacitor arrangement.

31. The device according to claim 16 wherein the device is a print head of a continuously operating ink jet printer.

32. A method for increasing the number of ink drops in an ink drop jet of a continuously operating inkjet printer, comprising:

electrically charging ink drops of at least two separately produced ink drop jets;

combining the ink drops from the at least two separately produced ink drop jets to an ink drop jet by deflection in at least one electric field so that the combined ink drop jet includes the ink drops of the respective separate ink drop jets; and wherein at least one of the separate ink drop jets is guided field-free through an electrode arrangement for deflection of at least one other separate ink drop jet.

33. A method for increasing the number of ink drops in an ink drop jet of a continuously operating inkjet printer, comprising:

electrically charging ink drops of at least two separately produced ink drop jets;

combining the ink drops from the at least two separately produced ink drop jets to an ink drop jet by deflection in at least one electric field so that the combined ink drop jet includes the ink drops of the respective separate ink drop jets; and wherein groups of separate ink drop jets are combined to an ink drop jet, which in turn are combined again.

34. A device for generating an ink drop jet of a continuously operating inkjet printer, comprising:

at least two pressure chambers for generating a separate ink drop jet with electrically charged ink drops and at least one electrode arrangement structured to combine the separate ink drop jets into an ink drop jet;

wherein at least one separate ink drop jet can be deflected so that it is combined with at least one other separate ink drop jet into an ink drop jet;

wherein the electrode arrangement for combining two separate ink drop jets is formed by a first electrode and a second electrode between which a third electrode is arranged, in which a first separate ink drop jet runs between the first and third electrodes and a second ink drop jet runs between the second and third electrodes; and wherein a third separate ink drop jet runs through the third electrode, which runs field-free through the electrode and is arranged coaxial to the combined ink drop jet.

35. A device for generating an ink drop jet of a continuously operating inkjet printer, comprising:

at least two pressure chambers for generating a separate ink drop jet with electrically charged ink drops and at least one electrode arrangement structured to combine the separate ink drop jets into an ink drop jet, wherein at least one separate ink drop jet can be deflected so that it is combined with at least one other separate ink drop jet into an ink drop jet; and wherein the electrode arrangement for combining the separate ink drop jets has an additional electrode arrangement positioned behind it to stabilize the flight paths of the individual ink drops of the combined ink drop jet.

* * * * *

UNITED STATES PATENT AND TRADEMARK OFFICE

CERTIFICATE OF CORRECTION

PATENT NO. : 7,429,100 B2
APPLICATION NO. : 11/683646
DATED : September 30, 2008
INVENTOR(S) : Klaus Pechtl It is certified that error appears in the above-identified patent and that said Letters Patent is hereby corrected as shown below:

Cover page left column should include -- (73) Assignee: KBA-Metronic AG, Veitshochheim, Germany --.

Signed and Sealed this

Second Day of June, 2009

JOHN DOLL
*Acting Director of the United States Patent and Trademark Office*